US009816528B2

(12) United States Patent
Johann

(10) Patent No.: US 9,816,528 B2
(45) Date of Patent: Nov. 14, 2017

(54) FLUID-FLOW MACHINE

(75) Inventor: Erik Johann, Berlin (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 925 days.

(21) Appl. No.: 13/451,657

(22) Filed: Apr. 20, 2012

(65) Prior Publication Data

US 2012/0269619 A1 Oct. 25, 2012

(30) Foreign Application Priority Data

Apr. 20, 2011 (DE) ..... 10 2011 007 767

(51) Int. Cl.

| | |
|---|---|
| ***F04D 29/66*** | (2006.01) |
| ***F01D 25/06*** | (2006.01) |
| ***F01D 25/24*** | (2006.01) |
| ***F01D 11/08*** | (2006.01) |
| ***F04D 29/16*** | (2006.01) |

(Continued)

(52) U.S. Cl.

CPC ..... *F04D 29/661* (2013.01); *F01D 11/08* (2013.01); *F01D 25/06* (2013.01); *F04D 29/164* (2013.01); *F04D 29/526* (2013.01); *F04D 29/685* (2013.01)

(58) Field of Classification Search

CPC ..... F05B 2240/14; F05B 2260/96; F05B 2260/962; F05B 2260/964; F05B 2260/966; F05D 2260/96; F05D 2260/961; F05D 2260/962; F05D 2230/90; F01D 25/24; F01D 511/08; F01D 511/12; F01D 511/122; F01D 511/125; F01D 511/127; F01D 25/06; F01D 11/08; F01D 11/12; F01D 11/122; F01D 11/125; F01D 11/127;

(Continued)

(56) References Cited

U.S. PATENT DOCUMENTS

| | | | | |
|---|---|---|---|---|
| 3,890,060 | A * | 6/1975 | Lipstein | 415/119 |
| 4,531,362 | A * | 7/1985 | Barry et al. | 60/226.1 |

(Continued)

FOREIGN PATENT DOCUMENTS

| | | |
|---|---|---|
| DE | 4108930 | 10/1991 |
| DE | 3521798 | 8/1992 |

(Continued)

OTHER PUBLICATIONS

Johann—U.S. Appl. No. 13/431,408, filed Mar. 27, 2012.

(Continued)

*Primary Examiner* — Dwayne J White
*Assistant Examiner* — Joshua R Beebe
(74) *Attorney, Agent, or Firm* — Shuttleworth & Ingersoll, PLC; Timothy Klima

(57) ABSTRACT

A fluid-flow machine includes at least one rotor having a rotary element with a plurality of rotor blades arranged on the rotary element, and a circumferential casing having a central axis and surrounding the rotor. The circumferential casing or a part connected thereto has an annular space surface on the inside, which delimits a flow duct of the fluid-flow machine radially outwards. The annular space surface has a structuring at least in one area adjoining a rotor on the circumferential side. At least one structuring of the annular space surface has, relative to the central axis of the circumferential casing, a circumferentially asymmetrical design.

19 Claims, 4 Drawing Sheets

Figure 1:
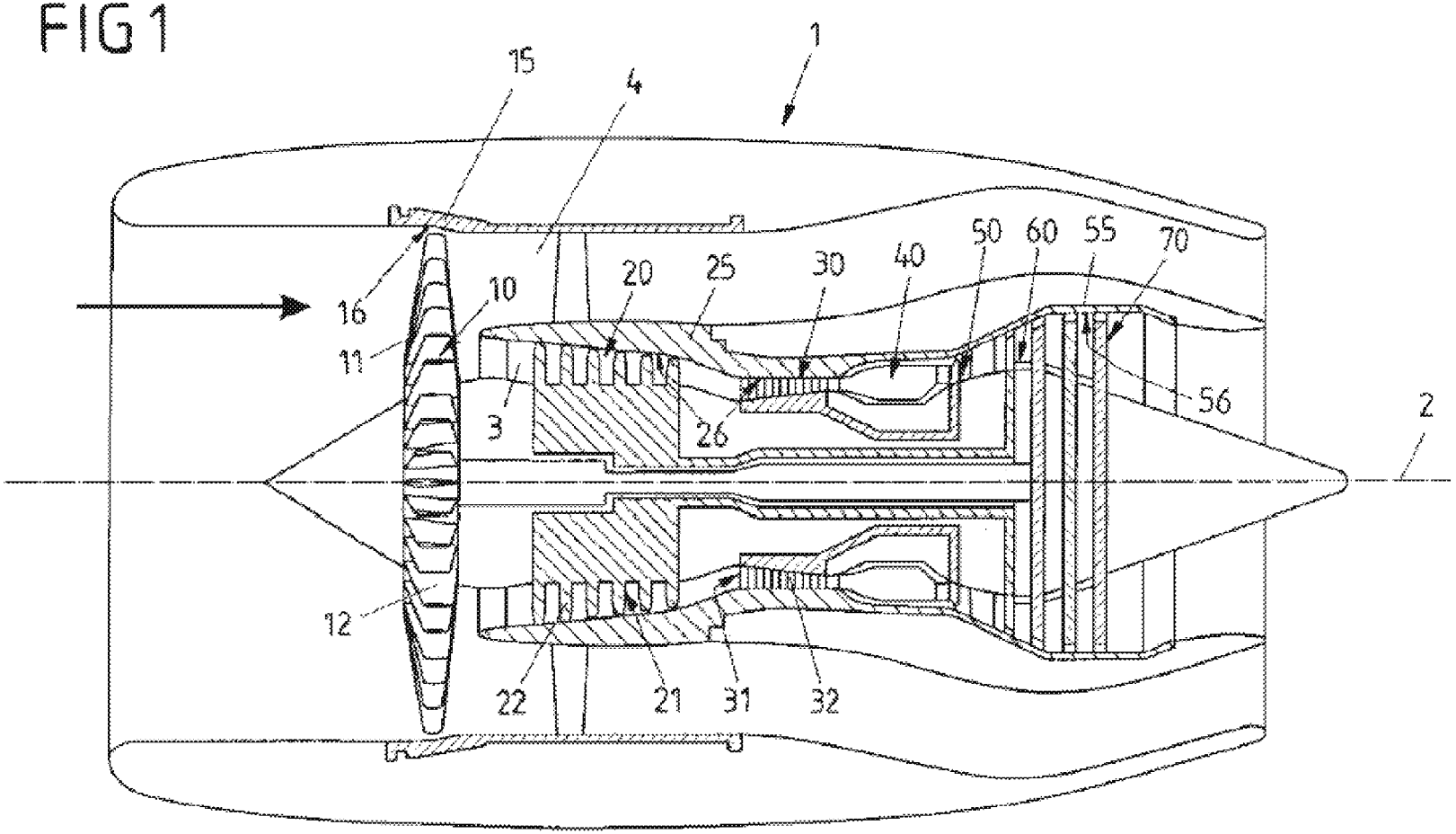

(51) Int. Cl.
*F04D 29/52* (2006.01)
*F04D 29/68* (2006.01)

(58) Field of Classification Search
CPC .... F04D 29/685; F04D 29/661; F04D 29/164; F04D 29/326; F04D 29/66
USPC ..... 415/119, 200; 416/500
See application file for complete search history.

(56) References Cited

U.S. PATENT DOCUMENTS

| | | | | |
|---|---|---|---|---|
| 4,540,335 | A * | 9/1985 | Yamaguchi et al. | 415/129 |
| 5,067,876 | A | 11/1991 | Moreman, III | |
| 5,137,419 | A | 8/1992 | Waterman | |
| 5,725,353 | A | 3/1998 | Matheny et al. | |
| 5,950,308 | A | 9/1999 | Koff et al. | |
| 6,017,186 | A | 1/2000 | Hoeger et al. | |
| 6,283,713 | B1 | 9/2001 | Harvey et al. | |
| 6,290,458 | B1 * | 9/2001 | Irie et al. | 415/119 |
| 6,409,469 | B1 | 6/2002 | Tse | |
| 6,561,761 | B1 | 5/2003 | Decker et al. | |
| 6,736,594 | B2 | 5/2004 | Irie et al. | |
| 6,969,232 | B2 | 11/2005 | Zess et al. | |
| 7,134,842 | B2 | 11/2006 | Tam et al. | |
| 7,220,100 | B2 | 5/2007 | Lee et al. | |
| 7,354,243 | B2 | 4/2008 | Harvey | |
| 7,909,570 | B2 | 3/2011 | Durocher et al. | |
| 8,192,154 | B2 | 6/2012 | Sonoda et al. | |
| 8,439,643 | B2 | 5/2013 | Kuhne et al. | |
| 8,678,740 | B2 * | 3/2014 | Praisner et al. | 415/1 |
| 8,684,684 | B2 | 4/2014 | Clements et al. | |
| 8,690,523 | B2 | 4/2014 | Guemmer | |
| 8,721,280 | B2 | 5/2014 | Nakagawa et al. | |
| 2002/0127108 | A1 | 9/2002 | Crall et al. | |
| 2005/0111968 | A1 * | 5/2005 | Lapworth | 415/182.1 |
| 2006/0140768 | A1 | 6/2006 | Tam et al. | |
| 2007/0059177 | A1 | 3/2007 | Harvey | |
| 2007/0160459 | A1 * | 7/2007 | Tudor | 415/119 |
| 2007/0224038 | A1 | 9/2007 | Solomon et al. | |
| 2007/0258810 | A1 | 11/2007 | Aotsuka et al. | |
| 2007/0258819 | A1 | 11/2007 | Allen-Bradley et al. | |
| 2008/0199306 | A1 * | 8/2008 | Lebret | 415/131 |
| 2008/0232968 | A1 | 9/2008 | Nguyen | |
| 2009/0246007 | A1 | 10/2009 | Johann | |
| 2010/0014956 | A1 * | 1/2010 | Guemmer | 415/9 |
| 2010/0098536 | A1 | 4/2010 | Guemmer | |
| 2010/0172749 | A1 | 7/2010 | Mitsuhashi et al. | |
| 2011/0189023 | A1 | 8/2011 | Guimbard et al. | |
| 2012/0201692 | A1 | 8/2012 | Boston et al. | |

FOREIGN PATENT DOCUMENTS

| | | |
|---|---|---|
| DE | 69728500 | 8/2004 |
| DE | 60130577 T2 | 6/2008 |
| DE | 102007056953 | 5/2009 |
| DE | 102008021053 | 10/2009 |
| DE | 102008052401 | 4/2010 |
| EP | 1199439 | 4/2002 |
| EP | 1239116 | 9/2002 |
| EP | 1760257 | 3/2007 |
| EP | 1783346 | 5/2007 |
| EP | 2096316 | 9/2009 |
| EP | 1087100 | 4/2010 |
| EP | 2180195 | 4/2010 |
| GB | 2245312 | 1/1992 |
| GB | 2281356 | 3/1995 |
| GB | 2408546 | 6/2005 |
| WO | 95/34745 | 12/1995 |
| WO | 2008/046389 | 4/2008 |
| WO | 2009112776 A2 | 9/2009 |
| WO | 2009129786 | 10/2009 |
| WO | 2011022111 | 2/2011 |
| WO | 2011039352 | 4/2011 |

OTHER PUBLICATIONS

Johann—U.S. Appl. No. 13/431,427, filed Mar. 27, 2012.
European Examination Report dated Oct. 26, 2015 for related European Patent Application No. 12 164 964.4.
European Examination Report dated Feb. 10, 2016 for related European application No. 12161404.4.
F. Taremi and S.A. Sjolander and T.J. Praisner, Application of Endwall Contouring to Transonic Turbine Cascades: Experimental Measurements at Design Conditions, Proceedings of ASME Turbo Expo 2011, GT2011-46511, Jun. 5-10, 2011, Vancouver, Bristish Columbia, Canada.
F. Heinichen, V. Guemmer, A Plas & H.-P. Schiffer, Numerical Investigation of the Influence of Non-Axisymmetric Hub Contouring on the Performance of a Shrouded Axial Compressor Stator, CEAS Aeronautical Journal, ISSN 1869-5582, vol. 2, pp. 89-98, Combined 1-4, 2011.
E. Dick, Fundamentals of Turbomachines, Fluid Mechanics and Its Applications, Springer, pp. 254-263, ISBN 978-94-017-9626-2, 2015.
Herausgegeben Von Prof. Dr. Ing. Habil, Heinz M. Hiersig, VDI-Lexikon Maschinenbau, Lexicon Mechanical Engineering published by the Association of German Engineers, p. 193-194, 1995.
European Search Report dated Jun. 16, 2014 from related European application No. 12161404.4.
European Search Report dated Dec. 3, 2014 from related app No. EP 12161401.
European Search Report dated May 12, 2014 for related European Application No. 12164964.

* cited by examiner

FLUID-FLOW MACHINE

This application claims priority to German Patent Application DE102011007767.7 filed Apr. 20, 2011, the entirety of which is incorporated by reference herein.

This invention relates to a fluid-flow machine. Such fluid-flow machines can be, for example, compressors used in jet engines.

The rotor blades of compressors tend, due to their design and loading, towards a structural vibration excitation. A distinction is made here between excitations from blade interactions ("forced response") and self-induced flutter. This applies for example for low-pressure compressors, medium-pressure compressors and high-pressure compressors of a jet engine, in particular for their front rotor blades, including the fan stage of a jet engine. The excitation sources for an unwanted vibration of the blades are of a fluid-mechanic nature, where the acoustic design of the flow duct can strengthen the effect.

In the case of engine compressors, design variants are known in which the inner annular space of the circumferential casing is designed substantially smooth, with the rotor moving for example relative to a liner in order to minimize the annular gap between the tips of the rotor blades and the annular space surface of the casing. The smooth annular space surface leads to the formation of a stationary gap swirl at the blade tip, which promotes buildup of a blockage in the blade passage and hence reinforces synchronous (flutter) and non-synchronous blade vibrations.

There is thus a risk that rapidly rotating and slender compressor blades in particular are excited to non-synchronous blade vibrations or flutter. Thin compressor blades in particular tend to vibrate, since their structural stability and damping properties are relatively poor. Here the so-called "flutter bite", i.e. a markedly reduced flutter stability in a certain speed range, is for example limiting when determining the working line of a low-pressure compressor. In addition to the already explained vibration excitations, there are losses in efficiency and power density due to the non-optimum determination of the working line. Verification of sufficient flutter stability furthermore represents a sensitive approval criterion for jet engines.

The aforementioned problems also occur in a corresponding manner in other fluid-flow machines besides compressors, for example in blowers, pumps and fans.

A fluid-flow machine is known from DE 10 2007 056 953 A1 that forms a flow duct between a rotor provided with rotor blades and a circumferential casing. The circumferential casing has on the inside a structuring formed by grooves running in the circumferential direction. This is intended to influence the boundary layer in the blade tip area.

There is a need to provide compressors and other fluid-flow machines which are distinguished by an improved flutter stability.

The present invention provides in this connection a fluid-flow machine having a rotor with a plurality of rotor blades and a circumferential casing surrounding the rotor and having a central axis. The circumferential casing or a part connected thereto has an internal annular space surface delimiting radially outwards an annular space or a flow duct of the fluid-flow machine. It is provided in accordance with the invention that the annular space surface has at least in an area adjoining a rotor on the circumferential side a circumferentially asymmetrical structuring, i.e. the structuring of the annular space surface is, relative to the central axis of the circumferential casing, given a circumferentially asymmetrical design.

Due to the circumferentially asymmetrical design of the annular space surface, the flutter stability of the rotor blades is considerably improved. This could be proved using the example of compressors in various compressor and engine tests. Due to the improved flutter stability, the working range too of a compressor and of each compressor stage of the compressor can be expanded, where the efficiency can be increased and the weight reduced by suitable selection of the working range. The circumferentially asymmetrical casing contouring in accordance with the invention and the advantages this entails may also permit a reduction in the number of rotor blades, which in turn can lead to a lower weight and reduced costs. The non-circumferentially symmetrical structuring of the annular space surface furthermore leads to a reduction in the sensitivity of the gap swirl losses in the event of a change of the blade tip gap.

It is pointed out that the circumferential asymmetry demanded in accordance with the invention for the structuring of the annular space surface represents a more difficult challenge than the absence of a rotational symmetry. Rotational symmetry applies when a rotation about any angle reproduces the object onto itself. Rotational symmetry is already no longer present when the annular space surface is symmetrically structured, for example has a periodic sequence of elevations and depressions, since for a periodic structuring of this type only rotations about certain angles (corresponding to the period length) reproduce the structuring onto itself. In accordance with the invention, a circumferential asymmetry is provided, i.e. there is no angle except the 360° angle that reproduces the structuring onto itself after a rotation.

The circumferentially asymmetrical structuring of the annular space surface can be achieved in various ways. In one exemplary embodiment the annular space surface has at least one section extending in the circumferential direction which provides a break in symmetry in an otherwise symmetrical structuring of the annular space surface in the circumferential direction. In other words, the annular space surface is structured symmetrically, for example by a periodic sequence of recesses, and this symmetrical structuring is interrupted in at least one section extending in the circumferential direction. For example, a recess has a different width or a different shape than outside the section providing the symmetry break. It can also be provided that the section considered is designed non-structured, in particular smooth, while the annular space surface outside this section is given a circumferentially symmetrical structure.

It can also be provided that several sections providing a symmetry break are designed in the annular space surface. These sections are however not arranged symmetrically to one another, so that they cannot be reproduced onto one another by a rotation about an angle unequal to 360°.

In a further exemplary embodiment, the annular space surface has, to provide a circumferential asymmetry, at least one section extending in the circumferential direction that structures the annular space surface asymmetrically in the circumferential direction, while the annular space surface is otherwise designed substantially smooth in the circumferential direction. In this design variant, the annular space surface is thus generally speaking not structured and instead designed smooth. Structuring is only achieved by the at least one section extending in the circumferential direction. The provision of such a section inherently leads to a circumferential asymmetry. If several such sections are provided, they are not arranged symmetrically, so that here too a circumferential asymmetry is provided.

In a further exemplary embodiment, the annular space surface has, to provide a circumferential asymmetry, at least one section extending in the circumferential direction that structures the annular space surface asymmetrically in the circumferential direction, with the annular space surface furthermore featuring at least one symmetrical structuring in the circumferential direction. With this design variant, a circumferentially asymmetrical structuring is thus superimposed on a circumferentially symmetrical structuring.

In an embodiment of the invention, it is provided that the annular space surface for providing a circumferentially symmetrical structuring has at least one section extending in the circumferential direction, the radius of which differs from that of the other sections with reference to the central axis. In particular, it can be provided that the annular space surface has at least one section extending in the circumferential direction and formed by a recess or a depression. One or more such recesses or depressions can be provided here. In the case of several recesses or depressions, they are formed circumferentially asymmetrically on the annular space surface, hence a circumferential asymmetry prevails overall.

A recess of this type has for example the form of a groove or a depression.

The structuring of the annular space surface is achieved in one embodiment by axially aligned structures, for example by axially aligned recesses such as axial grooves. This means that the structures or recesses are not designed continuous in the circumferential direction, but extend over a certain axial length in the axial direction. In particular, it is provided that the axial structures extend at least in the area of the rotor blade cascade of the respective rotor in the axial direction, i.e. in that area of the annular space directly adjoining the rotor blades. It can however also be provided that the circumferentially asymmetrical casing structuring is also provided in axial areas of the circumferential casing positioned in front of and/or behind a considered rotor blade cascade. It can also be provided that each rotor of a considered fluid-flow machine is assigned a different and individual circumferential asymmetry of the casing or its annular space.

In design variants of the present invention, it can furthermore be provided that the structuring of the annular space surface has structures extending in the circumferential direction, for example circumferential grooves, that are for example interrupted to provide a circumferential asymmetry.

The provision of a structuring for the inner annular space surface of the circumferential casing can be achieved in various ways. In one design variant, the circumferential casing itself is structured circumferentially asymmetrically, i.e. on the inside of the casing itself asymmetrical structures are provided. In accordance with an alternative design variant, the circumferential casing is connected on the inside to a liner. An insert of this type is frequently located in the area of the front rotor blades of compressors. A circumferentially asymmetrical structuring is designed for this case in the liner.

A structuring of the circumferential casing or of a part connected to the circumferential casing on the inside, such as a liner, is for example provided by milling out or erosion, for example by electrodischarge machining, of the casing or the liner. Axial structurings in particular, such as axial grooves, can be integrated into the circumferential casing in a simple manner while so doing. The additional expenditure is substantially limited to only providing recesses or pockets in the casing or in such separate liners.

Figure 2:
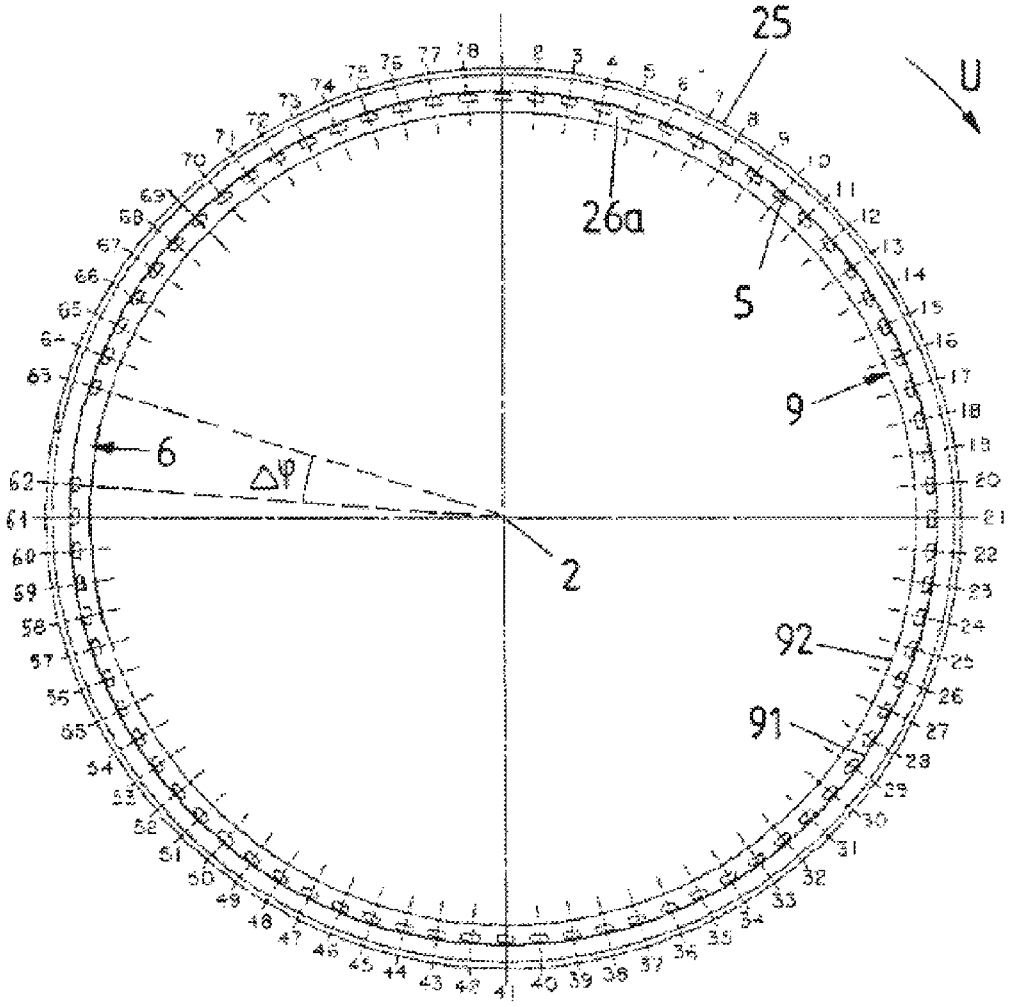
Figure 3:
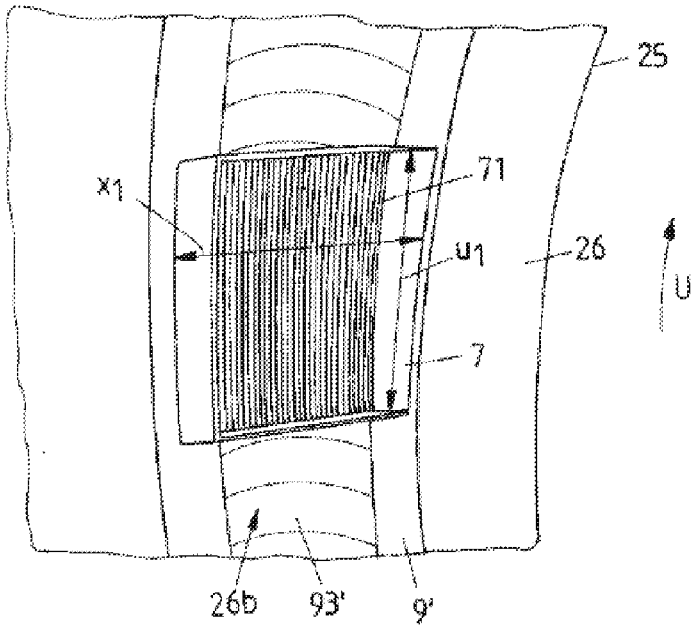
Figure 4:
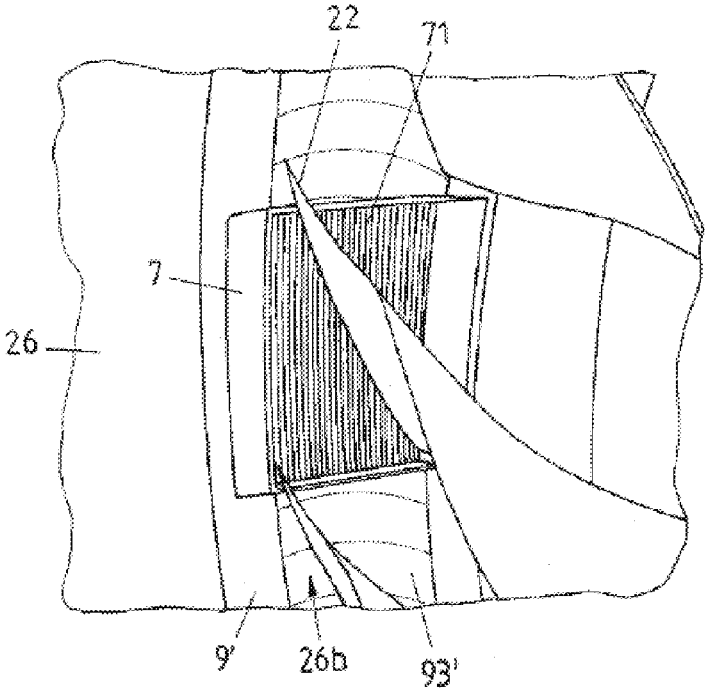
Figure 5:
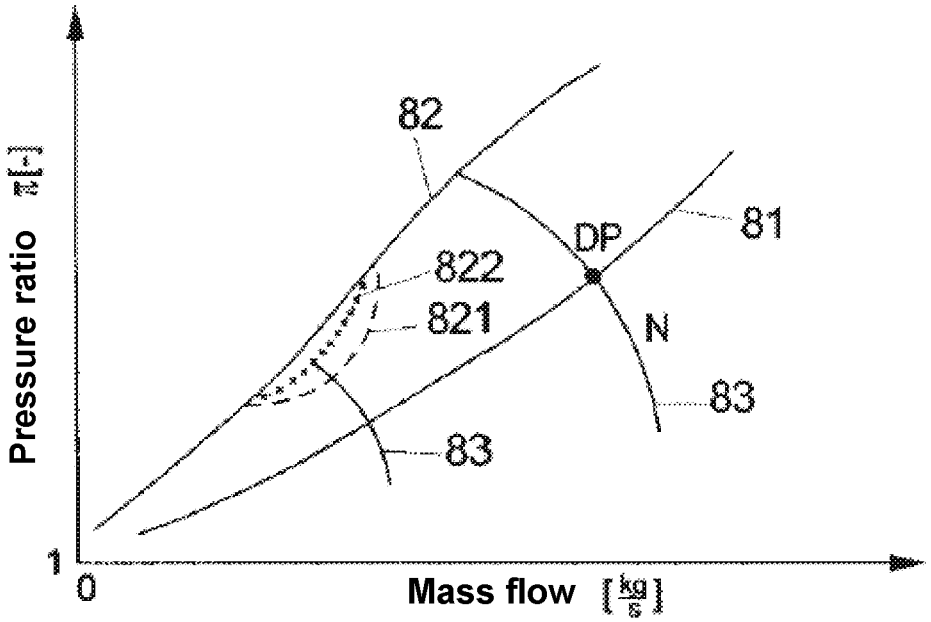

The present invention is described below in greater detail in light of the figures of the accompanying drawings, showing several embodiments. In the drawings, FIG. 1 shows an exemplary embodiment of a jet engine, with at least one compressor stage of the jet engine having a circumferentially asymmetrical structuring of the casing, FIG. 2 shows in a view from the front a first exemplary embodiment of a circumferentially asymmetrical structuring of the annular space surface of a compressor casing provided with a liner, FIG. 3 shows in perspective representation a second exemplary embodiment of a circumferentially asymmetrical structuring of the annular space surface of a compressor casing provided with a liner, with only a partial area of the circumferential casing being shown, FIG. 4 shows the exemplary embodiment of FIG. 3, with rotor blades of a rotor of the compressor being represented additionally, and FIG. 5 shows a characteristics field of a compressor showing the mass flow through a compressor as a function of the compressor pressure ratio, with the influence of a circumferentially asymmetrical structuring of the annular space surface on the stability line of the characteristics field being represented.

The invention is described in the following by examples using compressor stages of a jet engine. The principles of the present invention apply however in the same way for other fluid-flow machines, such as blowers, pumps and fans, for example. The fluid-flow machines can be of the axial, semi-axial or radial type and in general be operated with any gaseous or liquid working medium.

The fluid-flow machine in accordance with the invention has at least one rotor including a rotary element with a plurality of rotor blades arranged on the rotary element.

A circumferential casing of the fluid-flow machine has on the inside an annular space surface with circumferentially asymmetrical structuring. In the case of the fluid-flow machine being designed as a compressor, a rotor and a stator each form a stage. This is however only an exemplary embodiment of the present invention. The circumferentially asymmetrical structuring in accordance with the invention can also be achieved in a fluid-flow machine including only one rotor.

FIG. 1 shows an exemplary embodiment of a dual-flow jet engine 1 having in a manner known per se a fan stage 10 with a fan as a low-pressure compressor, a medium-pressure compressor 20, a high-pressure compressor 30, a combustion chamber 40, a high-pressure turbine 50, a medium-pressure turbine 60 and a low-pressure turbine 70. The fan stage can additionally have booster stages, not shown. The fan represents a part of the low-pressure compressor 10, since its area close to the hub represents the compressor inlet plane for the primary flow of the jet engine.

The fan stage 10 has a fan casing 15. The fan casing 15 has an internal annular space surface 16 delimiting radially outwards a secondary flow duct 4 of the jet engine 1.

The low-pressure compressor 20 and the high-pressure compressor 30 are surrounded by a circumferential casing 25 which has on the inside an annular space surface 26 delimiting the flow duct 3 for the primary flow of the jet engine 1 radially outwards. The flow duct 3 is connected radially inwards by appropriate ring surfaces of the rotors and stators of the respective compressor stage or by the hub or elements of the appropriate drive shaft connected to the hub. The flow duct 3 for the primary flow is also referred to as an annular space. Accordingly, the surface 26 represents an annular space surface.

In the area of the turbines 50, 60, 70 too, a circumferential casing 55 is provided that forms an inside annular space surface 56.

The fan stage 10 or the low-pressure compressor has a fan 11 including a rotary element with a plurality of fan blades 12. The fan 11 forms a rotor and the fan blades 12 form rotor blades of the rotor. The medium-pressure compressor 20 in the same way has rotors 21 (only shown schematically in FIG. 1) with a rotary element and rotor blades 22. The same applies for the high-pressure compressor 30, which has rotors 31 with in each case a rotary element and a plurality of rotor blades 32 arranged on the rotary element (only shown schematically).

In a corresponding manner, the high-pressure turbine 50, the medium-pressure turbine 60 and the low-pressure turbine 70 each have stages with a rotor and a stator, with the rotor including a plurality of rotor blades arranged on a rotary element. To prevent a confused representation in FIG. 1, these rotors of the turbine stages are not identified separately in FIG. 1.

The components described have a common symmetry axis 2 representing the central axis for the stators and the casings and the rotary axis for the rotors of the engine.

For all rotors 11, 21, 31 considered in FIG. 1 of the compressor stages 10, 20, 30, 50, 60, 70 a high flutter stability must be aimed at. This applies particularly for the respective front rotor blades of the individual compressor stages 10, 20 30, but to a lesser extent also for the rotor blades of the other rotors of the respective compressor stages 10, 20, 30. In particular, the formation of a gap swirl at the blade tip of the respective rotor blades 12, 22, 32, leading to blade vibration, must be prevented or reduced. The gap swirl leads here to a tendency to blade flutter disadvantageous from the fluid-mechanic viewpoint.

The present invention provides an approach which alters the boundary conditions at the inside annular space surface 16, 26, 56 of the respective circumferential casing 15, 25, 55 or of a part connected thereto, such that the gap swirl is reduced or completely eliminated. To do so, a circumferentially asymmetrical structuring is provided on one or a plurality of the casings 15, 25, 55 or on their inside annular space surfaces 16, 26, 56, and is explained in the following in light of the FIGS. 2 to 4 showing two exemplary embodiments. In FIG. 1, the circumferentially asymmetrical structuring of the annular space surface 16, 26, 56 cannot be discerned.

The jet engine 1 shown in FIG. 1 represents only one exemplary embodiment. The jet engine can also be designed in another way, for example with a different number of compressor stages and turbine stages and/or as a single-flow engine. The subsequently explained circumferentially asymmetrical structuring of the inside annular space surface of a circumferential casing is considered wherever a rotor with a plurality of rotor blades is surrounded by a circumferential casing. The annular space surfaces 16, 26, 56 shown in FIG. 1 must therefore also be understood merely as examples.

FIG. 2 shows a first exemplary embodiment for a circumferential asymmetry of the inside annular space surface of a circumferential casing 25. The circumferential casing 25 is for example the circumferential casing 25 of FIG. 1. FIG. 2 shows the circumferential casing 25 seen from front to rear in the direction of the central axis 2 of the circumferential casing 25.

A liner 9 is inserted into the circumferential casing 25 on the inside. The liner 9 has—relative to the direction of viewing in FIG. 2—a front edge 91 and a rear edge 92. Since the liner 9 tapers towards the rear in the exemplary embodiment shown, the rear edge 92 has a shorter radial distance to the central axis 2 than the front edge 91.

The liner 9 forms on its inside facing the central axis 2, an annular space surface (or annular surface) **26*a*** that delimits the adjoining flow duct radially outwards. The annular space surface is generally formed either by the inside of the casing itself or, where present, by the inside of a liner or of another part attached on the inside.

The liner 9 has, except for an interruption section 6 extending in the circumferential direction U, a symmetrical structuring of the annular space surface **26*a* provided by a plurality of recesses 5, by 78 recesses in the exemplary embodiment shown, which structure the annular space surface 26*a* at regular intervals in the circumferential direction. The recesses 5** extend in each case in the axial direction and have a length corresponding substantially to the width of the rotor blades of the associated rotor, not shown. In other words, the circumferentially symmetrical casing structuring extends along an axial area of the circumferential casing which adjoins the associated rotor on the circumferential side and corresponds substantially to the axial extent of the blade cascade of the rotor.

It is however pointed out that the axial recesses 5 can also have another length, and can for example be designed shorter, so that they only correspond to a fraction of the axial length of the blade cascade of the associated rotor, or can be designed longer so that they extend into areas of the circumferential casing or the liner located in front of and/or behind the respective blade cascade.

The axially extending recesses 5 are for example created by internal milling or erosion of the liner 9. They can form axial grooves or pockets.

It is pointed out that a structuring corresponding to the recesses 5, where no liner 9 is present, can alternatively also be created on the casing wall of the casing 25 itself.

The symmetrical structuring shown in FIG. 2 with axial recesses 5 does not however run along the entire circumference of the annular space surface **26*a*. Instead a symmetry break is provided in the form of the section 6 extending in the circumferential direction U, in which section the annular space surface 26*a* is designed smooth, i.e. without axial recesses 5. Outside the section 6, the annular space surface 26*a* is thus given a circumferentially symmetrical structure, but not however in the section 6**, which extends here over a defined circumferential angle $\Delta\phi$.

Due to the non-structured area 6, the structuring of the annular space surface is overall without circumferential symmetry, since the structuring can overall be reproduced onto itself only by a rotation about an angle of 360°.

The circumferential asymmetry shown in FIG. 2 can undergo numerous modifications. For example in a first alternative embodiment several sections 6 can be provided in which the annular space surface **26*a* is not structured. These sections 6** would be distributed asymmetrically over the circumference such that the structuring in turn can only be reproduced onto itself by a rotation about an angle of 360°.

In a second alternative embodiment, it can be provided that the symmetrical structuring provided by the axial recesses 5 also extends into the section 6, where however an additional circumferentially asymmetrical structuring is then provided in section 6, for example a depression, in which the axial recesses 5 are then provided. In this case, an asymmetrical structuring in the circumferential direction would be superimposed on a symmetrical structuring in the circumferential direction.

A further alternative embodiment provides that only a section extending in the circumferential direction, corresponding to section 6 in FIG. 2, has any structuring at all, while the annular space surface 26*a* outside this section is designed smooth. This would to that extent be a reversal of the situation shown in FIG. 2.

An exemplary embodiment of a design variant of this type is shown in FIGS. 3 and 4. FIG. 3 shows a perspective view onto the inside of a circumferential casing 25 which corresponds for example to the circumferential casing 25 in FIG. 1, but could also be the circumferential casing 15 or the circumferential casing 55 of FIG. 1. The circumferential casing 25 forms on the inside an annular space surface 26 that delimits the flow duct 3 (cf. FIG. 1) radially outwards. A liner 9' is arranged on the inside of the circumferential casing 25. Where the liner 9' is arranged, its surface 26*b* facing the flow duct forms the annular space surface of the casing 25.

The liner 9' is designed concave in a central area 93'. This concave design is achieved in that the liner 9' is milled out by the rotor blades 22 of the associated rotor. The liner 9' consists here of a relatively soft material. Provision of a liner 9' in this way entails the advantage of a small annular gap between the blade tips of the rotor blades 22 and the annular space surface 26*b*.

FIG. 4 corresponds to FIG. 3, where in FIG. 4 rotor blades 22 of the associated rotor are shown additionally.

A recess 7 is provided in the liner 9'. This recess is for example provided by erosion or milling of the liner 9'. The recess 7 can have elongated grooves 71, which arise during manufacture of the recess 7 and are optional. Outside the recess 7, the liner 9' is not structured, i.e. is designed smooth. The recess 7 thus provides a circumferentially asymmetrical structure of the annular space surface 26*b*.

The recess 7 has an axial length x1 which is slightly larger than the axial extent of the area 93' of the liner 9' adjoining the rotor blades 22 of the associated rotor on the circumferential side. The axial extent x1 of the recess 7 is thus slightly larger than the axial extent of the blade cascade of the associated rotor. Alternatively, it can be just as large or smaller than the axial extent of the blade cascade.

The recess 7 furthermore has a length u1 in the circumferential direction U which corresponds to a circumferential angle $\Delta\phi 1$ of the associated sector.

In the exemplary embodiment of FIGS. 3 and 4 too, several recesses 7 can be provided along the circumference of the liner 9', with these several recesses being arranged circumferentially asymmetrically.

FIG. 5 makes clear the advantages entailed by the circumferentially asymmetrical design of the annular space surface. The circumferentially asymmetrical design of the annular space surface reduces the vibration excitation of rotor blades and hence improves flutter stability. In FIG. 5, the compressor pressure ratio is presented as a function of the mass flow. The reference numeral 81 indicates the working line and the point DP a considered design point. The reference numeral 82 indicates the stability line, also referred to as pump limit. The characteristics fields comprise lines 83 with constant speed N.

To the left the characteristics field area is delimited by the stability line 82. If a current operating point is beyond the stability line, a stall results.

Blade flutter leads to a denting of the stability line 82, which in this case is replaced by the flutter line 821. The circumferentially asymmetrical structuring of the annular space surface in accordance with the invention leads to the dent in the stability line 82 being reduced, so that the stability line 82 is replaced by the flutter line 822 with annular space asymmetry. The distance between the flutter line 821 without annular space asymmetry and the flutter line 822 with annular space asymmetry makes clear the advantages entailed by the annular space asymmetry in accordance with the invention. The distance of an operating point on the working line 81 to the stability line 82 is advantageously increased.

The invention is restricted in its design not to the exemplary embodiments presented above, which must be understood merely as examples. For example, structures can be provided which are designed and arranged in a different way, with different shapes and/or at different locations than described in the exemplary embodiments, to provide a circumferential asymmetry of the annular space surface.

What is claimed is:

1. A fluid-flow machine, comprising:

at least one rotor having a rotary element with a plurality of rotor blades arranged on the rotary element, and a circumferential casing having a central axis and surrounding the rotor, at least one of the circumferential casing or a component connected thereto having an internal annular space surface which radially outwardly delimits a flow duct of the fluid-flow machine, the annular space surface having a structuring in at least one area adjacent the rotor having a circumferential asymmetry relative to the central axis, and wherein the annular space surface includes at least one interruption section extending in a circumferential direction, the interruption section providing the circumferential asymmetry and being formed by a recess, the annular space surface having exactly one recess or the annular space surface having a plurality of recesses provided circumferentially asymmetrically in the annular space surface;

wherein an axial extent of the recess is larger than an entire axial extent of a blade row of the at least one rotor to extend both upstream and downstream of the entire axial extent of the blade row.

2. The fluid-flow machine of claim 1, wherein the annular space surface is smooth along a circumference thereof not occupied by the interruption section.

3. The fluid-flow machine of claim 1, wherein the annular space surface also includes at least one symmetrical structuring in the circumferential direction.

4. The fluid-flow machine of claim 1, wherein the recess has at least one radius which differs from a radius of the annular space surface along a circumference thereof not occupied by the interruption section, with reference to the central axis.

5. The fluid-flow machine of claim 1, wherein the annular space surface has exactly one recess.

6. The fluid-flow machine of claim 5, wherein the annular space surface has a plurality of recesses, which are provided circumferentially asymmetrically in the annular space surface.

7. The fluid-flow machine of claim 5, wherein the recess in a section in a plane perpendicular to the central axis has at least one of a bent or rectangular shape.

8. The fluid-flow machine of claim 1, wherein the circumferential casing includes the annular space surface.

9. The fluid-flow machine of claim 1, and further comprising a liner connected internally to the circumferential casing, the liner including the annular space surface.

10. The fluid-flow machine of claim 1, wherein the annular space surface is provided in an area of a blade cascade of a rotor.

11. The fluid-flow machine of claim 10, wherein the annular space surface is also provided in axial areas of at least one of the circumferential casing or a part connected thereto, the axial areas being located at least one of ahead of or behind an adjacent blade cascade.

12. The fluid-flow machine of claim 1, wherein the fluid-flow machine is a compressor of a jet engine.

13. The fluid-flow machine of claim 1, wherein the recess includes a plurality of circumferentially extending and same shaped parallel grooves.

14. The fluid-flow machine of claim 13, wherein the recess has a constant axial length and a constant circumferential length.

15. A fluid-flow machine, comprising:

at least one rotor having a rotary element with a plurality of rotor blades arranged on the rotary element, and a circumferential casing having a central axis and surrounding the rotor, at least one of the circumferential casing or a component connected thereto having an internal annular surface which radially outwardly delimits a flow duct of the fluid-flow machine, the annular surface adjacent the rotor having a circumferential asymmetry relative to the central axis by having a first circumferential section having a surface structuring and a second circumferential section having a substantially smooth surface, wherein the surface structuring includes at least one interruption section extending in a circumferential direction, the interruption section providing the circumferential asymmetry and being formed by a recess, the surface structuring having exactly one recess or the surface structuring having a plurality of recesses provided circumferentially asymmetrically in the annular surface;

wherein an axial extent of the recess is larger than an entire axial extent of a blade row of the at least one rotor to extend both upstream and downstream of the entire axial extent of the blade row.

16. The fluid-flow machine of claim 15, wherein the surface structuring has exactly one recess.

17. The fluid-flow machine of claim 15, wherein the surface structuring has a plurality of recesses, which are provided circumferentially asymmetrically in the annular space surface.

18. The fluid-flow machine of claim 15, wherein the recess includes a plurality of circumferentially extending and same shaped parallel grooves.

19. The fluid-flow machine of claim 18, wherein the recess has a constant axial length and a constant circumferential length.

* * * * *